US007327336B2

(12) United States Patent
Park

(10) Patent No.: US 7,327,336 B2
(45) Date of Patent: Feb. 5, 2008

(54) APPARATUS AND METHOD FOR DRIVING ELECTRO-LUMINESCENT DISPLAY PANEL AND METHOD OF FABRICATING ELECTRO-LUMINESCENT DISPLAY DEVICE

(75) Inventor: Joon Kyu Park, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 721 days.

(21) Appl. No.: 10/825,599

(22) Filed: Apr. 16, 2004

(65) Prior Publication Data

US 2005/0012695 A1 Jan. 20, 2005

(51) Int. Cl.
*G09G 3/30* (2006.01)

(52) U.S. Cl. ..... 345/76; 345/80

(58) Field of Classification Search ..... 345/60–100
See application file for complete search history.

(56) References Cited

U.S. PATENT DOCUMENTS 6,943,760 B2 * 9/2005 Bae et al. ..... 345/76
7,102,600 B2 * 9/2006 Kasai ..... 345/77
2003/0189541 A1 * 10/2003 Hashimoto ..... 345/89
2004/0036664 A1 * 2/2004 Miyazawa ..... 345/76
2004/0095304 A1 * 5/2004 Hiroki ..... 345/87

* cited by examiner

*Primary Examiner*—David L. Lewis
(74) *Attorney, Agent, or Firm*—Morgan, Lewis & Bockius LLP

(57) ABSTRACT

An apparatus and method for driving an electro-luminescent display panel and a method of fabricating the electro-luminescent display panel includes an electro-luminescent display panel having electro-luminescent light-emitting cells provided at crossings of gate lines and data lines. A current generating circuit generates a current corresponding to an externally supplied digital data. A data driver samples the current from the current generating circuit during each horizontal period to generate a data voltage corresponding to the current and applies the generated data voltage to the data lines. A timing controller controls the data driver, applies the digital data to the current generating circuit, and generates a sampling control signal. The sampling control signal controls the data driver. and applies the sampled signal to the data driver.

19 Claims, 8 Drawing Sheets

APPARATUS AND METHOD FOR DRIVING ELECTRO-LUMINESCENT DISPLAY PANEL AND METHOD OF FABRICATING ELECTRO-LUMINESCENT DISPLAY DEVICE

The present invention claims the benefit of Korean Patent Application No. 40489/2003 filed in Korea on Jun. 21, 2003, which is hereby incorporated by reference.

BACKGROUND OF THE INVENTION

1. Field of the Invention

This invention relates to an electro-luminescence display (ELD), and more particularly to an apparatus and method for driving, and a method of fabricating an electro-luminescence display panel.

2. Description of the Related Art

In general, flat panel display devices have a reduced weight and size. Because of the reduction in weight and size, flat panel display devices eliminate some disadvantages associated with cathode ray tubes (CRT). Such flat panel display devices include liquid crystal displays (LCD), field emission displays (FED), plasma display panels (PDP) and electro-luminescence (EL) displays.

An EL display is a self-luminous device capable of emitting light by re-combination of electrons with holes in a phosphorous material. The EL display has some of the same advantages as a CRT in that it has a faster response than a passive-type light-emitting device like LCD, which requires a separate light source. EL displays are classified into current driving systems and voltage driving systems.

FIG. 1 is a section view showing a structure of an organic light-emitting cell in a general electro-luminescence display panel in accordance with a related art. Referring to FIG. 1, the organic EL device of the EL display includes an electron injection layer 4, an electron carrier layer 6, a light-emitting layer 8, a hole carrier layer 10 and a hole injection layer 12. The layers are sequentially disposed between a cathode 2 and an anode 14.

When a voltage is applied between a transparent electrode (the anode 14), and a metal electrode (the cathode 2), electrons produced from the cathode 2 are moved through the electron injection layer 4 and the electron carrier layer 6 into the light-emitting layer 8. Concurrently, holes produced in the anode 14 are moved through the hole injection layer 12 and the hole carrier layer 10 to the light-emitting layer 10. Thus, electrons and holes fed from the electron carrier layer 6 and the hole carrier layer 10, respectively, recombine at the light-emitting layer and generate light. The generated light is emitted outside of the device through the transparent electrode (the anode 14) to thereby display a picture.

FIG. 2 is a block diagram showing a configuration of a driving apparatus for the general electro-luminescence display panel in accordance with the related art. Referring to FIG. 2, the related art active matrix type EL display includes an EL display panel 16 having pixel (hereinafter "PE") cells 22 arranged at each crossing of one of the gate electrode lines GL and one of the data electrode lines DL. The EL display panel also includes a gate driver 18 for driving the gate electrode lines GL. The EL display panel further includes a data driver 20 for driving the data electrode lines DL. The EL display panel further includes a timing controller 28 for controlling the data driver 20 and the gate driver 18.

FIG. 3 is an equivalent circuit diagram of each pixel cell in accordance with the related art. Referring to FIG. 3, the related art active matrix type EL display includes an external current generating circuit 32. The external current generating circuit 32 is connected to the data electrode lines DL.

The timing controller 28 generates gate control signals GCS to control a driving of the gate driver 18 for driving the gate electrode lines GL. The timing controller 28 also generates data control signals DCS to control a driving of the data driver 20 for driving the data electrode lines DL. Further, the timing controller 28 aligns externally supplied data signals and applies them to the data driver 20.

The gate driver 18 generates gate signals for sequentially enabling the gate electrode lines GL in response to the gate control signals GCS from the timing controller 28. The generated gate signals include a start pulse and a clock signal. The gate driver 18 sequentially applies the gate signals to the gate electrode lines GL.

The data driver 20 applies data signals from the timing controller 28, through the data electrode lines DL, to the pixel cells 22 in response to the control signals from the timing controller 28. The data driver 20 applies data signals for each horizontal line to the data electrode lines DL every horizontal period when the gate driver 18 drives each of the gate electrode lines GL.

Each pixel cell 22 is selected when a gate signal is applied to a cathode (the gate electrode line GL). The selected pixel cell generates light in accordance with a pixel signal, which is a current signal. The pixel signal is supplied to an anode, data electrode line DL. Each pixel cell 22 can be equivalently expressed as a diode connected between the data electrode line DL and the gate electrode line GL. Such a pixel cell 22 is driven by a gate signal, which is enabled on the gate electrode line GL. Thus, the pixel cell generates light in accordance with a magnitude of the data signal on data electrode line DL.

Each pixel cell 22 includes a supply voltage line VDD, a light-emitting cell OLED and a light-emitting cell driving circuit 30. Each pixel cell also includes a light-emitting cell driving circuit 30. The light-emitting cell OLED is connected between the supply voltage line VDD and a ground voltage source GND. The light-emitting cell driving circuit 30 drives the light-emitting cell OLED in response to a driving signal from each of the data electrode lines DL and the gate electrode lines GL.

As shown in FIG. 3, the light-emitting cell driving circuit 30 includes a driving thin film transistor (TFT) T1 connected between the supply voltage line VDD and the light-emitting cell OELD. The light-emitting cell driving circuit 30 also includes a first switching TFT T3 connected to the gate electrode line GL and the data electrode line DL. The light-emitting cell driving circuit 30 further includes a second switching TFT T4 connected to the first switching TFT T3 and the gate electrode line GL. The light-emitting cell driving circuit 30 further includes a converter TFT T2. The light-emitting cell driving circuit 30 further includes a storage capacitor Cst connected between a gate terminal of each of the driving TFT T1 and the converter TFT T2 and the supply voltage line VDD. Herein, the TFT is a p-type electron metal-oxide semiconductor field effect transistor (MOSFET).

The converter TFT T2 is connected between a node positioned between the first switching TFT T3 and the second switching TFT T4, and the supply voltage line VDD. The converter TFT T2 forms a current mirror circuit with respect to the driving TFT T1. Thereby, the converter TFT T2 converts a current into a voltage.

A gate terminal of the driving TFT T1 is connected to the gate terminal of the converter TFT T2. A source terminal of the driving TFT T1 is connected to the supply voltage line VDD. A drain terminal of the driving TFT T1 is connected to the light-emitting cell OLED.

A source terminal of the converter TFT T2 is connected to the supply voltage line VDD. A drain terminal of the converter TFT T2 is connected to a drain terminal of the first switching TFT T3 and a source terminal of the second switching TFT T4.

A source terminal of the first switching TFT T3 is connected to the data electrode line DL. A drain terminal of the first switching TFT T3 is connected to a source terminal of the second switching TFT T4, which is also connected to the drain terminal of converter TFT T2, as set forth above. A drain terminal of the second switching TFT T4 is connected to the gate terminal of driving TFT T1, the gate terminal of converter TFT T2 and the storage capacitor Cst. A gate terminal of each of the first switching TFT T3 and the second switching TFT T4 is connected to the gate electrode line GL.

The converter TFT T2 and the driving TFT T1 are presumed to have the same characteristics and are disposed adjacent to each other to form a current mirror circuit. Thus, a current amount flowing in the converter TFT T2 is equal to a current amount flowing in the driving TFT T2 when the converter TFT T2 has the same width to length dimension ratio as the driving TFT T2.

A driving of such a light-emitting cell driving circuit 30 is described as follows. First, if a gate ON signal is applied to the gate electrode line GL, then the first switching TFT T3 and the second switching TFT T4 are turned on. Subsequently, a data signal from the data electrode line DL is supplied through the first switching TFT T3 and the second switching TFT T4. The data signal turns on each of the driving TFT T1 and the converter TFT T2. Thus, the driving TFT T1 controls a current between the source terminal and the drain terminal thereof. The current is fed from the supply voltage line VDD in response to a data signal applied to the gate terminal of driving TFT T1. The driving TFT T1 applies the controlled current to the light-emitting cell OLED, thereby causing the light-emitting cell OLED to radiate with a brightness corresponding to the data signal.

Concurrently, the converter TFT T2 is connected, through the first switching TFT T3 and the data electrode line DL, to the external current generating circuit 32. Thus, a current id from the supply voltage line VDD is sunk, through the converter TFT T2 and the first switching TFT T3, into the external current generating circuit 32. When the current id from the supply voltage line VDD is being sunk into the external current generating circuit 32, a current flowing in the driving TFT T1 is equal to a current flowing in the converter TFT T2. This is because the driving TFT T1 and the converter TFT T2 form a current mirror circuit.

The storage capacitor Cst stores a voltage from the supply voltage line VDD depending upon an amount of the current id from the supply voltage line VDD sunk into the external current generating circuit 32. In other words, the storage capacitor stores a voltage between the gate terminal and the source terminal of the converter TFT T2 when the current id from the supply voltage line VDD is being sunk into the external current generating circuit 32.

On the other hand, if a gate OFF signal is applied to the gate electrode line GL, then the first switching TFT T3 and the second switching TFT T4 are turned off. Subsequently, the storage capacitor Cst drives the driving TFT T1 due to the stored voltage to thereby apply a current to the light-emitting cell OLED.

Such a related art active matrix type EL display can eliminate a stripe phenomenon generated between the adjacent pixel cells 22 due to a non-uniformity of the TFT's caused by a characteristic difference between poly silicon films configuring the TFT's by driving the EL display panel using the current-driving data driver. However, the related art active matrix type EL display has several drawbacks. For example, the related art active matrix type EL display includes four TFT's for driving the light-emitting cell OLED of each pixel cell 22. It also has a low aperture ratio when light is emitted from the light-emitting cell OLED through the anode, which is the transparent electrode.

SUMMARY OF THE INVENTION

Accordingly, the present invention is directed to an apparatus and method for driving, and a method of fabricating an electro-luminescence display panel that obviates one of more of the problems due to limitations and disadvantages of the related art.

An object of the present invention to provide an apparatus for converting an externally supplied current into a voltage for driving an electro-luminescent display panel.

Another object of the present invention to provide an apparatus for driving an electro-luminescent display panel having an increased aperture ratio.

Another object of the present invention to provide a method for converting an externally supplied current into a voltage for driving an electro-luminescent display panel.

Another object of the present invention to provide a method for driving an electro-luminescent display panel having an increased aperture ratio.

Another object of the present invention to provide a method of fabricating an electro-luminescent display panel having a driving circuit for converting an externally supplied current into a voltage.

Another object of the present invention is to provide a method of fabricating an electro-luminescent display panel having an increased aperture ratio.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, the driving apparatus for an electro-luminescence display panel includes an electro-luminescent display panel having electro-luminescent light-emitting cells provided at crossings of gate lines and data lines, a current generating circuit that generates a current corresponding to an externally supplied digital data, a data driver that samples the current from the current generating circuit for each horizontal period to generate a data voltage corresponding to the current and applies the generated data voltage to the data lines, and a timing controller that controls the data driver, applies the digital data to the current generating circuit, and generates a sampling control signal for controlling the data driver to apply the sampled signal to the data driver.

In another aspect, the method of driving an electro-luminescence display panel includes preparing an electro-luminescent display panel having electro-luminescent light-emitting cells provided at crossings of gate lines and data lines, generating a current corresponding to an externally provided digital data, sampling the current during each horizontal period to generate and store the data voltage corresponding to the current, applying the stored data voltage to the data lines, and driving the light-emitting cells using the data voltage.

In another aspect, the method of fabricating an electro-luminescent display panel includes providing an electro-luminescence display panel having electro-luminescent light-emitting cells arranged at crossings of gate lines and data lines, providing a current generating circuit for generating a current corresponding to a digital data from the exterior, and providing a data driver for sampling the current from the current generating circuit for each horizontal period, for generating the data voltage corresponding to the current, and for applying the data voltage to the data lines at one side of a substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
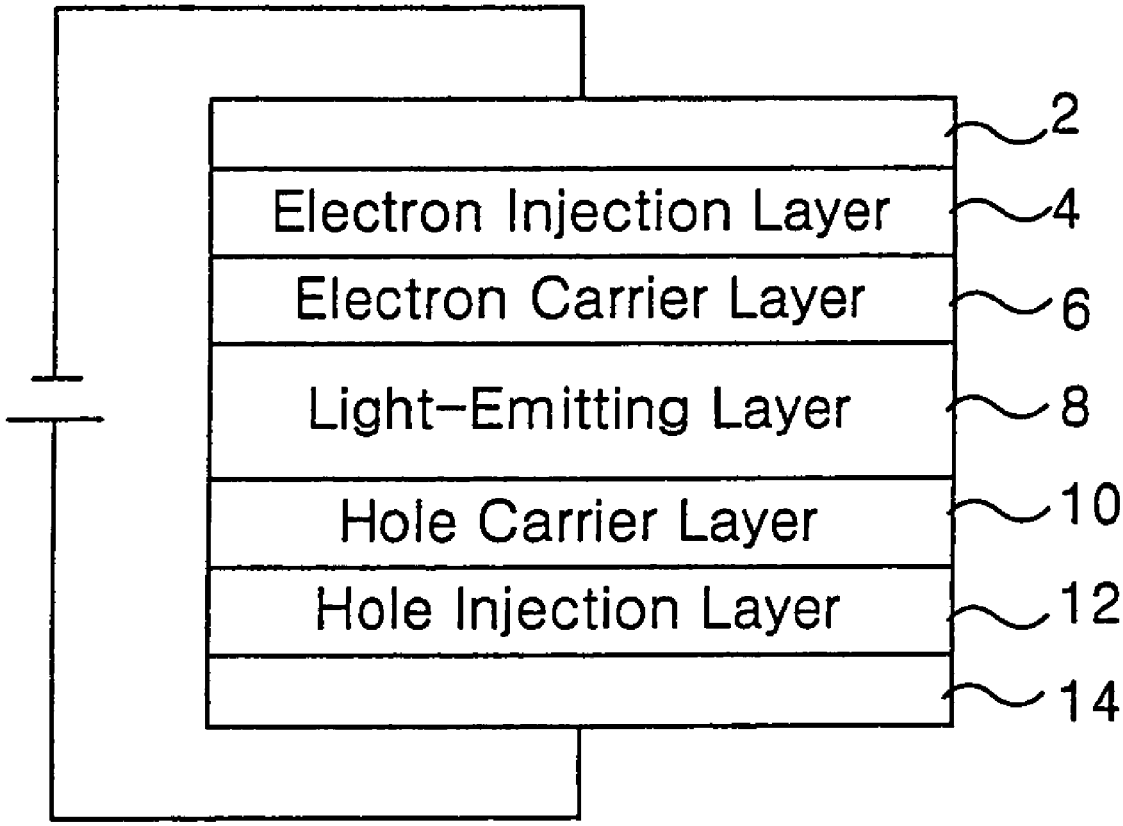
FIG. 1 RELATED ART
FIG. 1 is a section view showing a structure of an organic light-emitting cell in a general electro-luminescence display panel in accordance with a related art.
Figure 2:
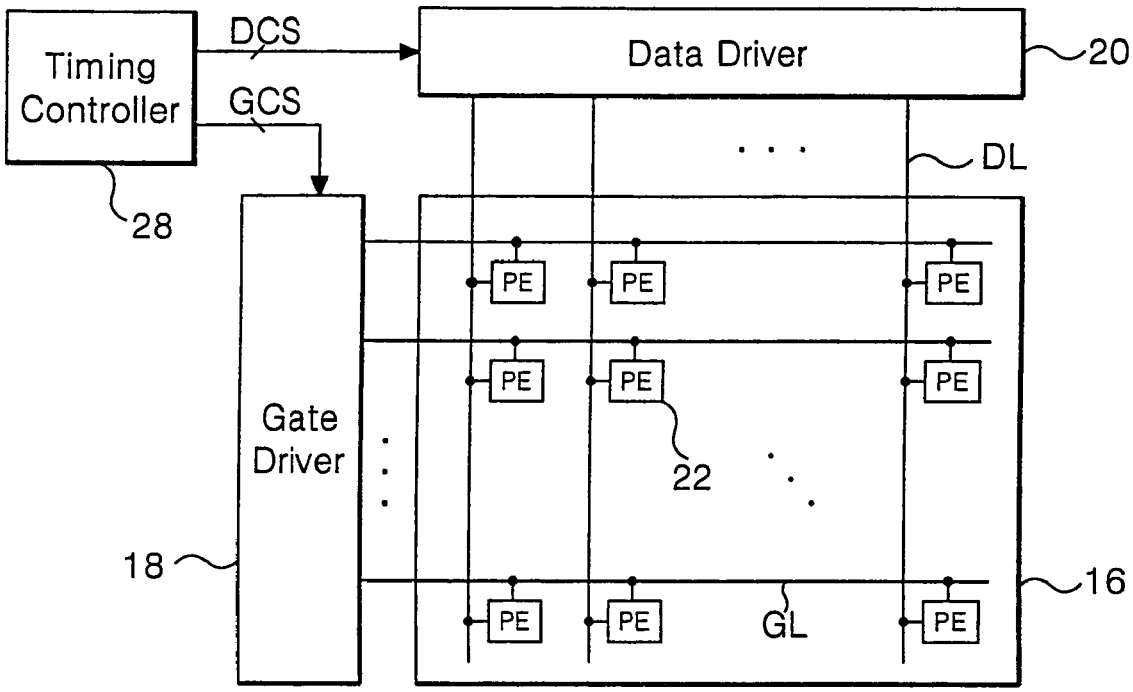
FIG. 2 RELATED ART
FIG. 2 is a block diagram showing a configuration of a driving apparatus for the general electro-luminescence display panel in accordance with the related art.
Figure 3:
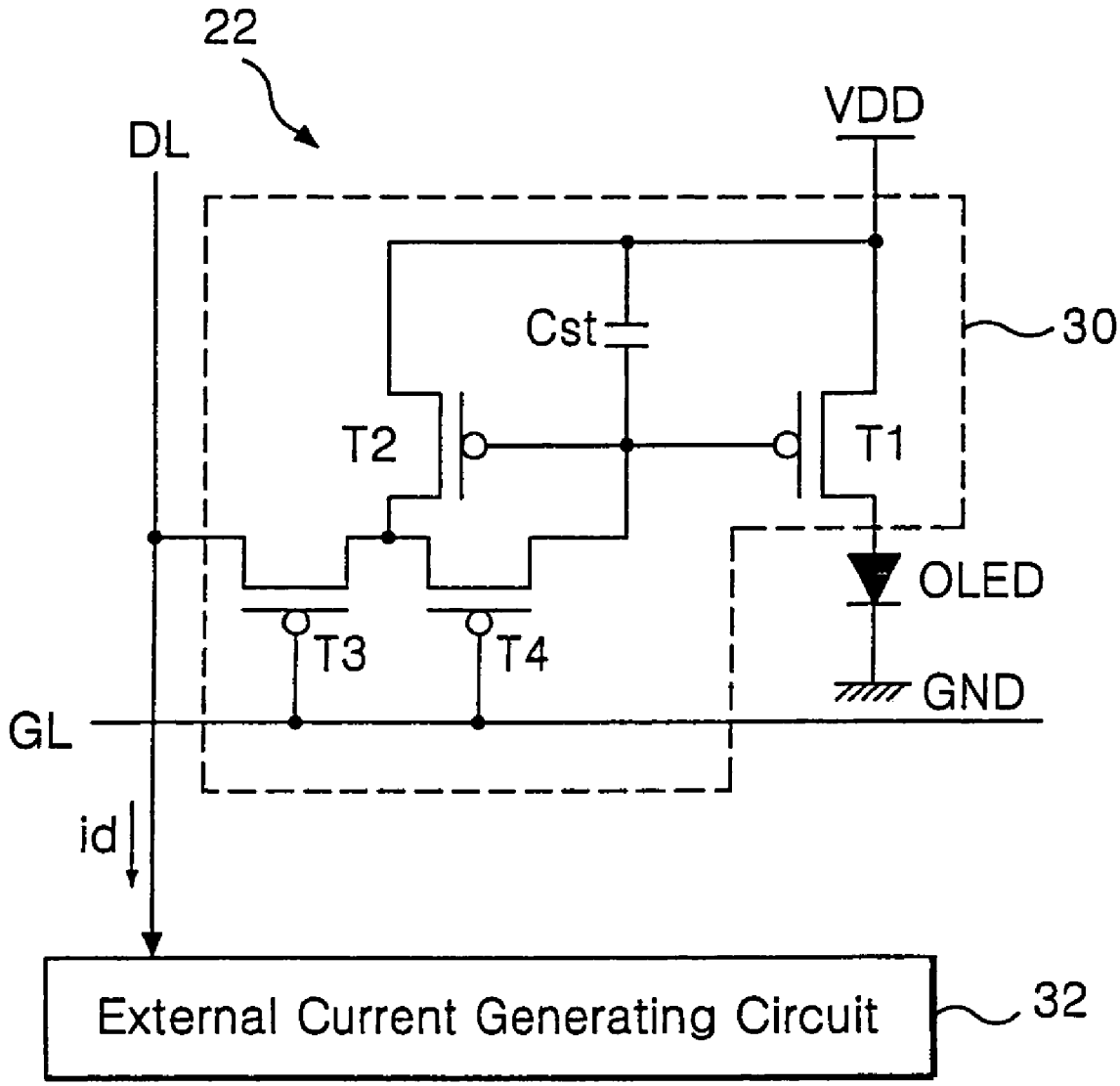
FIG.3 RELATED ART
FIG. 3 is an equivalent circuit diagram of each pixel cell in accordance with the related art.
Figure 4:
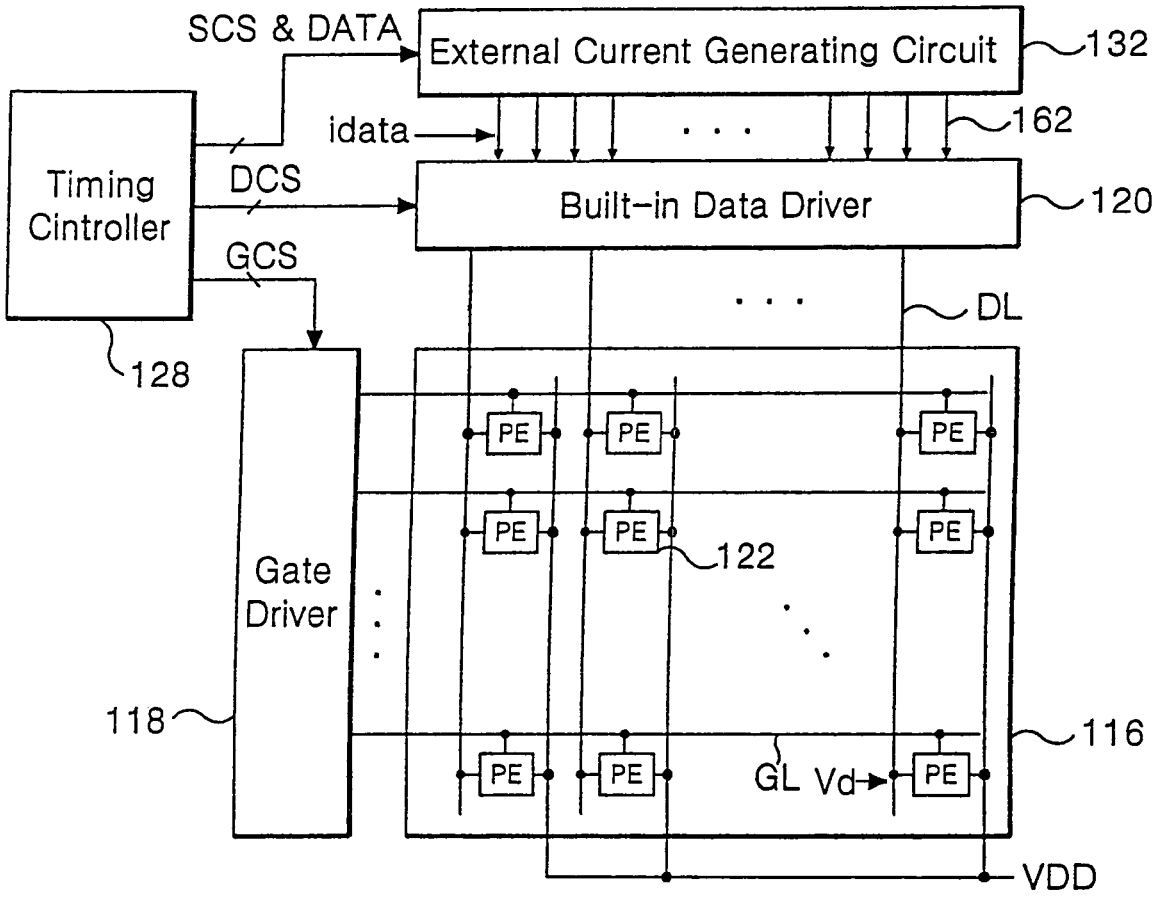
FIG. 4 is a block diagram showing a configuration of a driving apparatus for an electro-luminescence display panel according to an embodiment of the present invention.

FIG. 4 is a block diagram showing a configuration of a driving apparatus for an electro-luminescence display panel according to an embodiment of the present invention. Referring to FIG. 4, a driving apparatus for an electro-luminescence (EL) display panel includes an EL display panel 116 having pixel cells 122, each of which having two thin film transistors (TFT's). The driving apparatus also includes a gate driver 118 for driving the gate electrode lines GL. The driving apparatus further includes an external current generating circuit 132 for generating a current corresponding to a digital data from the exterior to apply it to a data driver 120. The driving apparatus includes a data driver 120. The driving apparatus further includes a timing controller 128 for controlling the data driver 120 and the gate driver 118 and for applying a digital data DATA to the external current generating circuit 132.

The pixel cells are arranged at each crossing of one of the gate electrode lines GL and one of the data electrode lines DL. The data driver 120 generates a data voltage Vd corresponding to a current idata fed from the external current generating circuit 132 using two sampling circuits. The data driver 120 applies the generated data voltage Vd to the data electrode lines DL.

The timing controller 128 generates gate control signals GCS to control a driving of the gate driver 18 for driving the gate electrode lines GL. The timing controller 128 generates data control signals DCS to control a driving of the data driver 120 for driving the data electrode lines DL. Further, the timing controller 128 aligns externally provided digital data DATA and applies the digital data DATA to the external current generating circuit 132.

The gate driver 118 generates gate signals for sequentially enabling the gate electrode lines GL in response to the gate control signals GCS from the timing controller 128. The gate signals include a start pulse and a clock signal. The gate driver 118 sequentially applies the gate signals to the gate electrode lines GL.

The external current generating circuit 132 generates a current idata corresponding to a digital data DATA from the timing controller 128 to apply it; through a data signal supply line 162, to the data driver 120. In other words, the external current generating circuit 132 sinks the current idata corresponding to the digital data DATA from the timing controller 128 from the data driver 120.

The data driver 120 generates a data voltage Vd corresponding to the current idata. The current idata is fed from the external current generating circuit 132, through the data signal supply line 162, in response to the control signals from the timing controller 128. The data driver 120 applies the data voltage Vd to the pixel cells 122, through the data electrode lines DL. In this case, the data driver 120 applies data voltages for each horizontal line to the data electrode lines DL every horizontal period when the gate driver 118 drives each of the gate electrode lines GL.

Figure 5:
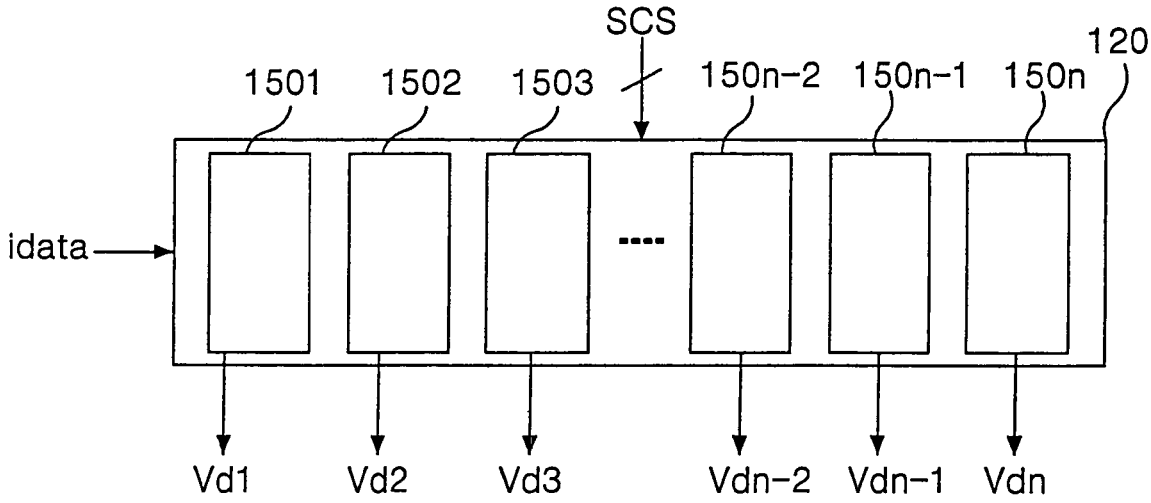
FIG. 5 is a block diagram of a data driver built in the electro-luminescent display panel according to an embodiment of the present invention.

FIG. 5 is a block diagram of a data driver built in the electro-luminescent display panel according to an embodiment of the present invention. As shown in FIG. 5, the data driver 120 includes a plurality of sampling drivers 150(1) to 150(n). The sampling circuits sample a current idata fed through the data signal supply line 162 alternately for each horizontal period 1H, thereby generating a data voltage Vd corresponding to the current idata.

Figure 6:
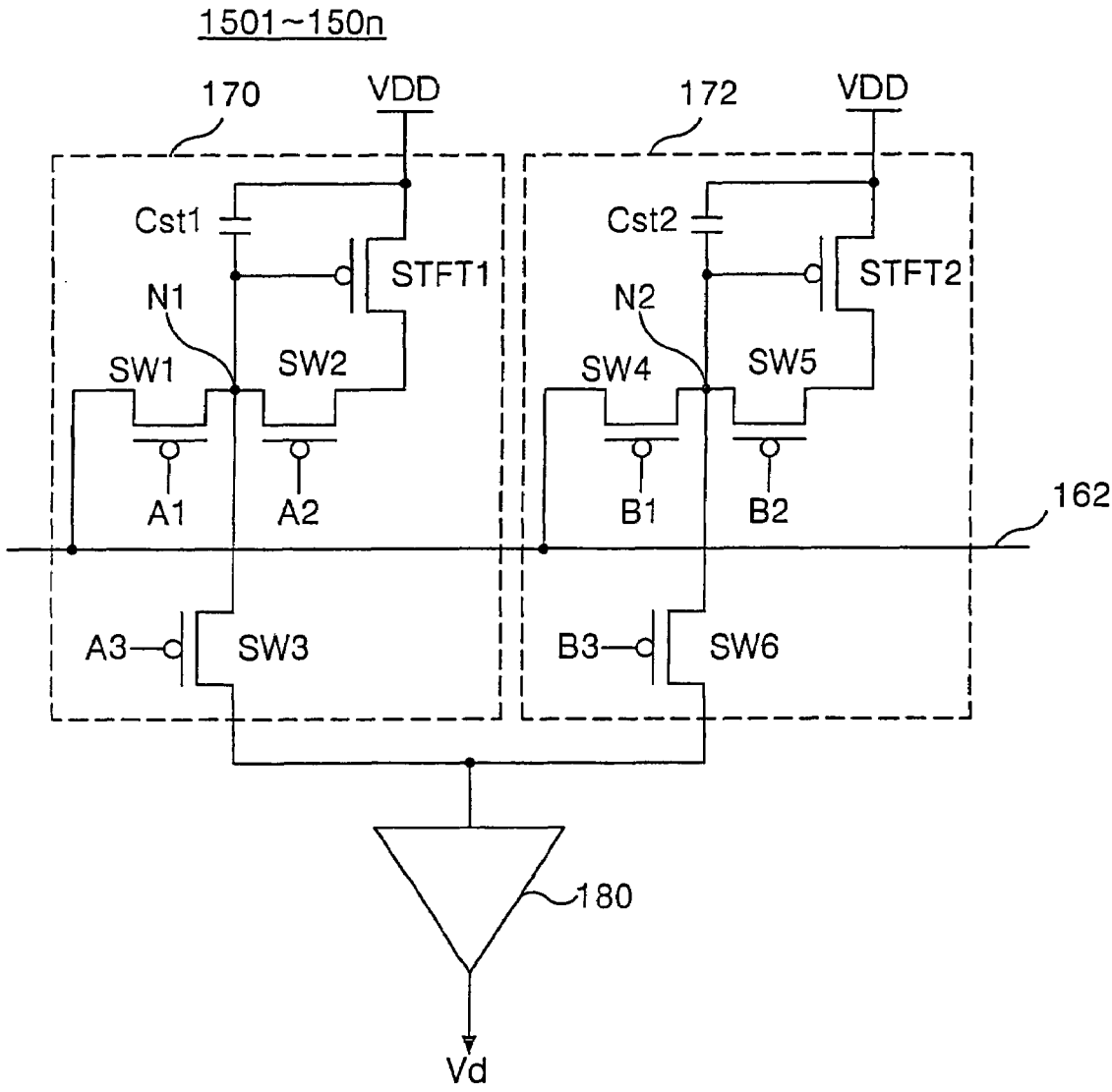
FIG. 6 is a circuit diagram of the sampling driver according to an embodiment of the present invention.

FIG. 6 is a circuit diagram of the sampling driver according to an embodiment of the present invention. As shown in FIG. 6, each of the plurality of sampling drivers 150(1) to 150(n) includes first and second sampling circuits 170 and 172 driven alternately for each horizontal period in response to a sampling control signal SCS from the timing controller 128 line. The driven sampling driver 150(1) to 150(n) generates a data voltage Vd corresponding to the current idata from the external current generating circuit 132. An analog buffer 180 is provided for buffering a data voltage applied alternately from each of the first and second sampling circuits 170 and 172. The analog buffer 180 applies the data voltage to the data line DL.

The first sampling circuit 170 includes a first switching TFT SW1 connected to the data signal supply line 162. The first sampling circuit 170 includes a second switching TFT SW2 connected to the first switching TFT SW1 at a first node N1. The first sampling circuit 170 also includes a first sampling TFT STFT1 connected between the second switching TFT SW2 and the supply voltage line VDD. The first sampling circuit 170 further includes a first storage capacitor Cst1. The first storage capacitor Cst1 is connected between the power supply VDD and the first node N1. The first sampling circuit 170 further includes a third switching TFT SW3 connected between the first node N1 and the analog buffer 180 to apply a voltage stored in the first storage capacitor Cst1 to the analog buffer 180. Thus, the first node N1 represents a junction point between the first storage capacitor Cst1, the first switching TFT SW1, the second switching TFT SW2 and the third switching TFT SW3. Herein, the TFT is a p-type electron metal-oxide semiconductor field effect transistor (MOSFET).

A source terminal of the first switching TFT SW1 is connected to the data signal supply line 162. A drain terminal of the first switching TFT SW1 is connected to a source terminal of the second switching TFT SW2 at the first node N1. A drain terminal of the second switching TFT SW2 is connected to a drain terminal of the first sampling TFT STFT1. The gate terminal of the first sampling TFT STFT1 is connected to the first storage capacitor Cst1 at the first node N1. A source terminal of the third switching TFT SW3 is connected to the first node N1. A drain terminal of the third switching TFT SW3 is connected to the analog buffer 180.

The second sampling circuit 172 has a circuit configuration similar to the above-mentioned first sampling circuit 170. The second sampling circuit 172 includes a fourth switching TFT SW4 connected to the data signal supply line 162. The second sampling circuit 172 includes a fifth switching TFT SW5 connected to the fourth switching TFT SW4 at a second node N2. The second sampling circuit 172 further includes a second sampling TFT STFT2 connected between the fifth switching TFT SW5 and the supply voltage line VDD. The second sampling circuit 172 also includes a second storage capacitor Cst2 connected between the second node N2 and the supply voltage line VDD. The second sampling circuit 172 further includes a sixth switching TFT SW6 connected between the second node N2 and the analog buffer 180 to apply a voltage stored in the second storage capacitor Cst2 to the analog buffer 180. Thus the second node N2 represents the junction point between the second storage capacitor Cst2, the fourth switching TFT SW4, the fifth switching TFT SW5 and the sixth switching TFT SW6. The TFT is can be p-type electron metal-oxide semiconductor field effect transistor (MOSFET).

A source terminal of the fourth switching TFT SW4 is connected to the data signal voltage line 162. A drain terminal of the fourth switching TFT SW4 is connected to a source terminal of the fifth switching TFT SW5 at the second node N2. A drain terminal of the fifth switching TFT SW5 is connected to a drain terminal of the second sampling TFT STFT2. A gate terminal of the second sampling TFT STFT2 is connected to the second storage capacitor Cst2 at the second node N2. A source terminal of the sixth switching TFT SW6 is connected to the second node N2. A drain terminal of the sixth switching TFT SW6 is connected to the analog buffer 180.

Figure 7:
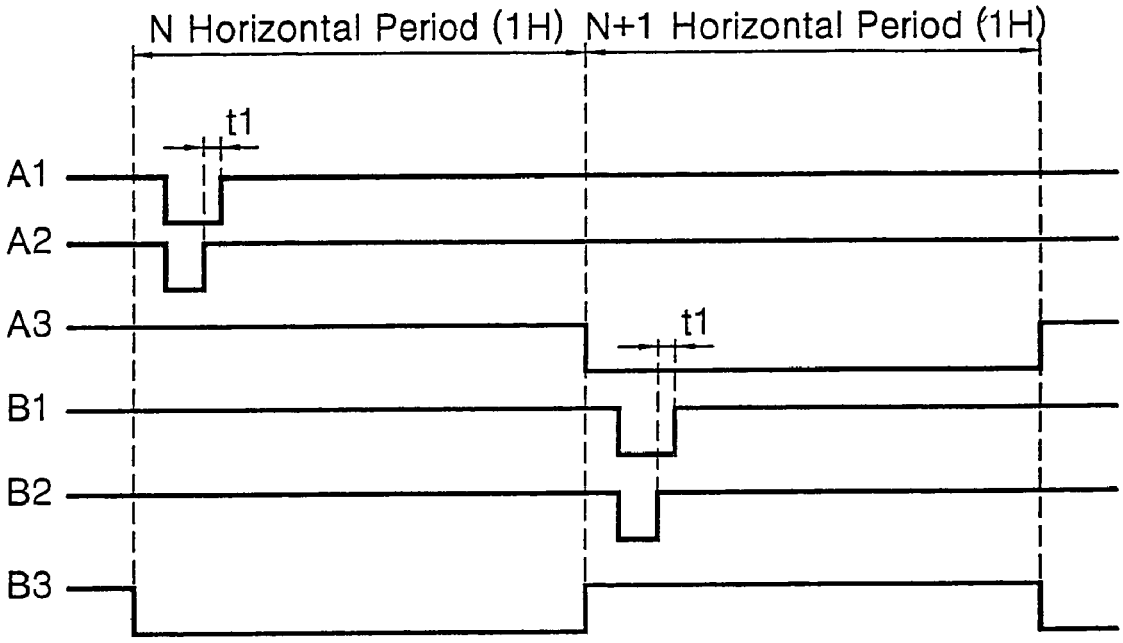
FIG. 7 is a driving timing diagram for driving the thin film transistor according to an embodiment of the present invention.

FIG. 7 is a driving timing diagram for driving the thin film transistor according to an embodiment of the present invention. The first to third switching TFT's SW1, SW2 and SW3 are driven with sampling control signals SCS from the timing controller 128. Similarly, the fourth to sixth switching TFT's SW4, SW5 and SW6 are driven with sampling control signals SCS from the timing controller 128. The control signals include A1, A2, A3, B1, B2 and B3, as depicted in FIG. 7. The analog buffer 180 applies data voltages alternately supplied from each of the first and second sampling circuits 170 and 172 to the data lines DL one at a time, and functions as a buffer.

An operation of each of the plurality of sampling drivers 150(1) to 150(n) shown in FIG. 6 will be described in reference to FIG. 7. First, it is assumed that a data voltage is stored in the second storage capacitor Cst2 of the second sampling circuit 172. Accordingly, the first sampling circuit 170 of each sampling driver 150(1) to 150(n) stores a data voltage into the first storage capacitor Cst1 in response to a sampling control signal SCS from the timing controller 128 during an horizontal period N. During such an N-th horizontal period, the second sampling circuit 172 applies the data voltage stored in the second storage capacitor Cst2 to the analog buffer 180. Thus, the analog buffer 180 buffers the data voltage from the second storage capacitor Cst2 of the second sampling circuit 172. The analog buffer 180 applies the buffered data voltage to the data line DL connected thereto.

Next, the second sampling circuit 172 of each sampling driver 150(1) to 150(n) stores a data voltage into the second storage capacitor Cst2 in response to a sampling control signal SCS from the timing controller 128 during an horizontal period (N+1). During such an (N+1)-th horizontal period, the first sampling circuit 170 applies the data voltage stored in the first storage capacitor Cst1 to the analog buffer 180. Thus, the analog buffer 180 buffers the data voltage from the first storage capacitor Cst1 of the first sampling circuit 170. The analog buffer 180 applies the buffered data voltage to the data line DL connected thereto. More specifically, the third switching TFT SW3 of the first sampling circuit 170 is switched to an off-state during the horizontal period N while the first switching TFT SW1 and the second switching TFT SW2 are supplied with an ON signal having a predetermined period. The sixth switching TFT SW6 of the second sampling circuit 172 is switched to an on-state while the fourth switching TFT SW4 and the second switching TFT SW5 are switched off. In this case, the data voltage Vd is stored in the second storage capacitor Cst2.

Accordingly, an ON signal is simultaneously applied to the first switching TFT SW1 and the second switching TFT SW2 during the N-th horizontal period to thereby turn on the first switching TFT SW1 and the second switching TFT SW2. When the first switching TFT SW1 and the second switching TFT SW2 are turned on, the first sampling TFT STFT1 is turned on by a current flowing through the first node N1 connected to the gate terminal thereof. Thus, the first sampling TFT STFT1 is connected to the data signal supply line 162 through the second and first switching TFT's SW2 and SW1. Accordingly, a voltage from the supply voltage line VDD is sunk into the external current generating circuit 132 through the first sampling TFT STFT1, the second switching TFT SW2, the first switching TFT SW1 and the data signal supply line 162.

A voltage between the gate terminal and the source terminal of the first sampling TFT STFT1 is then stored in the first storage capacitor Cst1. The voltage stored in the first storage capacitor Cst1 corresponds to a current generated from the external current generating circuit 132. To stabilize a voltage stored in the first storage capacitor Cst1, current leakage is prevented by sequentially turning off the first sampling TFT STFT1, the first switching TFT SW1 and the second switching TFT SW2 at a predetermined interval t1.

Meanwhile, during the N-th horizontal period, the second sampling circuit 172 applies a data voltage Vd stored in the second storage capacitor Cst2, through the sixth switching TFT SW6, to the analog buffer 180. Thus, the analog buffer 180 buffers the data voltage Vd supplied from the second storage capacitor Cst2 of the second sampling circuit 172. The analog buffer 180 applies the buffered data voltage to the data line DL connected thereto during the N horizontal period.

Next, during the (N+1)-th horizontal period, the sixth switching TFT SW6 of the second sampling circuit 172 is switched-off while the fourth switching TFT SW4 and the second switching TFT SW5 are supplied with an ON signal having a predetermined period. During the (N+1)-th horizontal period, the third switching TFT SW3 of the first sampling circuit 170 is switched-on while the first switching TFT SW1 and the second switching TFT SW2 are switched-off.

Accordingly, during the (N+1)-th horizontal period, the fourth switching TFT SW4 and the second switching TFT SW5 are simultaneously supplied with an ON signal to turn on the fourth switching TFT SW4 and the second switching TFT SW5. When the fourth switching TFT SW4 and the second switching TFT SW5 are turned on, the second sampling TFT STFT2 is turned on by a current flowing through the second node N2 connected to the gate terminal thereof. Thus, the second sampling TFT STFT2 is connected to the data signal supply line 162 through the fifth and fourth switching TFT's SW5 and SW4. Accordingly, a voltage supplied from the supply voltage line VDD is sunk, through the second sampling TFT STFT2, the fifth switching TFT SW5, the fourth switching TFT SW4 and the data signal supply line 162, into the external current generating circuit 132.

Then, a voltage between the gate terminal and the source terminal of the second sampling TFT STFT2 is stored in the second storage capacitor Cst2. The voltage stored in the second storage capacitor Cst2 corresponds to a current generated from the external current generating circuit 132. Then, in order to stabilize the voltage stored in the second storage capacitor Cst2, current leakage is prevented by sequentially turning off the second sampling TFT STFT2, the fourth switching TFT SW4 and the second switching TFT SW5 at a predetermined interval t1.

On the other hand, during the (N+1)-th horizontal period, the first sampling circuit 170 applies a data voltage Vd stored in the first storage capacitor Cst1 during the N horizontal period, through the third switching TFT SW3, to the analog buffer 180. Thus, the analog buffer 180 buffers the data voltage Vd supplied from the first storage capacitor Cst1 of the first sampling circuit 170. The analog buffer 180 applies the buffered data voltage to the data line DL connected thereto during the (N+1)-th horizontal period.

Each pixel cell 122 is selected when a gate signal is applied to a cathode (i.e., the gate electrode line GL), to thereby generate a light corresponding to a pixel signal supplied to an anode (i.e., the data electrode line DL), that is, a current signal. Each pixel cell 122 can be equivalently represented by a diode connected between the data electrode line DL and the gate electrode line GL. Such a pixel cell 122 is driven by a gate signal, which is enabled on the gate electrode line GL, thereby generating light in accordance with a magnitude of the data signal on the data electrode line DL.

Figure 8:
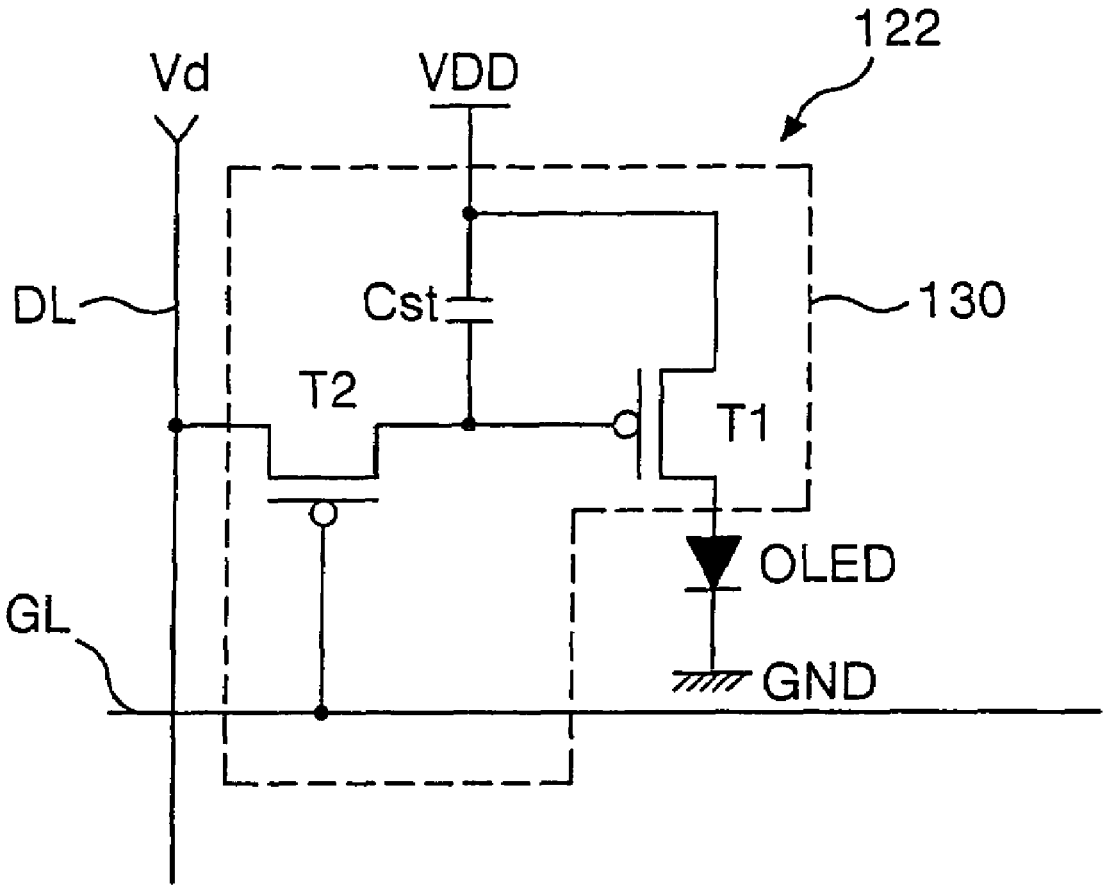
FIG. 8 is an equivalent circuit diagram of each pixel cell according to an embodiment of the present invention.

FIG. 8 is an equivalent circuit diagram of each pixel cell according to an embodiment of the present invention. As shown in FIG. 8, each pixel cell 122 includes a supply voltage line VDD. Each pixel cell 122 also includes a light-emitting cell OLED. Each pixel cell 122 further includes a light-emitting cell driving circuit 130. The light-emitting cell OLED is connected between the supply voltage line VDD and the light-emitting cell driving circuit 130. The light-emitting cell driving circuit 130 drives the light-emitting cell OLED in response to a driving signal from each of the data electrode line DL and the gate electrode line GL.

The light-emitting cell driving circuit 130 includes a driving thin film transistor (TFT) T1 connected between the supply voltage line VDD and the light-emitting cell OLED. The light-emitting cell driving circuit 130 also includes a switching TFT T2 connected to the gate electrode line GL and the data electrode line DL. The switching TFT T2 switches a data voltage Vd supplied from the analog buffer 180 of the data driver 120 into the gate terminal of the driving TFT T1. The light-emitting cell driving circuit 130 further includes a storage capacitor Cst. The capacitor Cst has one of its terminals connected to a node positioned between the drain terminal of the switching TFT T2 and the gate of driving TFT T1. The other terminal of the capacitor is connected to the supply voltage line VDD. Herein, the TFT is a p-type electron metal-oxide semiconductor field effect transistor (MOSFET).

A gate terminal of the driving TFT T1 is connected to the drain terminal of the switching TFT T2. A source terminal of terminal of the driving TFT T1 is connected to the supply voltage line VDD. A drain terminal of terminal of the driving TFT T1 is connected to the light-emitting cell OLED.

A source terminal of the switching TFT T2 is connected to the data electrode line DL. A drain terminal of the switching TFT T2 is connected to a gate terminal of the driving TFT T1 and the storage capacitor Cst. A gate terminal of the switching TFT T2 is connected to the gate electrode line GL.

A driving of such a light-emitting cell driving circuit 130 will be described below. First, when a gate ON signal is applied to the gate electrode line GL, the switching TFT T2 is turned on. When the switching TFT T2 is turned on, a data voltage Vd supplied through the data electrode line DL from the analog buffer 180 of the data driver 120 is applied through the switching TT T2 to the gate terminal of the driving TFT T1. Thus, the driving TFT T1 is turned on by a data signal supplied to the gate terminal thereof to control a current between the source terminal and the drain terminal thereof fed from the supply voltage line VDD. The driving TFT T1 applies the controlled current to the light-emitting cell OLED, thereby causing the light-emitting cell OLED to radiate with a brightness corresponding to the data signal. Concurrently, the storage capacitor Cst stores a voltage between the gate terminal and the source terminal of the driving TFT T1.

On the other hand, when a gate OFF signal is applied to the gate electrode line GL, the switching TFT T1 is turned off. When the switching TFT T1 is turned off, the storage capacitor Cst drives the driving TFT T1 due to the stored voltage thereby applying a current to the light-emitting cell OLED.

In an alternative embodiment of the present invention, each pixel cell can be configured to include at least two TFT's.

A method of fabricating the EL display according to an embodiment of the present invention provides an EL display panel, a current generating circuit, a data driver, a sampling driver for the data driver, a gate driver and a timing controller as mentioned above.

The apparatus and method of driving the electro-luminescence display panel and a method of fabricating the electro-luminescence display device according to the embodiment of the present invention generates a data voltage corresponding to the current from the external current generating circuit using the first and second sampling circuits of the data driver to thereby drive the light-emitting cell with the generated data voltage. Accordingly a stripe phenomenon generated between the adjacent pixel cells due to a non-uniformity of the TFT's, which is caused by a characteristic difference of poly silicon films configuring the TFT's, can be eliminated.

As described above, according to the present invention, the light-emitting cell is driven with at least two TFT's to thereby increase an aperture ratio of the electro-luminescence display panel. Furthermore, according to the present invention, the electro-luminescence display panel is driven by a complex system including a current driving circuit and the voltage driving circuit, thereby eliminating a stripe phenomenon generated between the adjacent pixel cells due to the related art current driving circuit.

It will be apparent to those skilled in the art that various modifications and variations can be made in apparatus and methods of the of the present invention without departing from the spirit or scope of the invention. Thus, it is intended that the present invention cover the modifications and variations of the invention provided they come within the scope of the appended claims and their equivalents.

What is claimed is:

1. A driving apparatus for an electro-luminescence display panel comprising:

an electro-luminescent display panel having electro-luminescent light-emitting cells provided at crossings of gate lines and data lines;

a current generating circuit that generates a current corresponding to an externally supplied digital data;

a data driver that samples the current from the current generating circuit for each horizontal period to generate a data voltage corresponding to the current and applies the generated data voltage to the data lines, wherein the data driver includes:

first and second sampling circuits for generating the data voltage; and an analog buffer for buffering the data voltage supplied from the first and second sampling circuits alternately for each horizontal period and applies the buffered data voltage to the data lines; and a timing controller that controls the data driver, applies the digital data to the current generating circuit, and generates a sampling control signal for controlling the data driver to apply the sampled signal to the data driver.

2. The driving apparatus according to claim 1, wherein each of the first and second sampling circuits includes:

a supply voltage line;

storage means for storing the data voltage corresponding to the current using a voltage from the supply voltage line, the storage means being driven with the sampling control signal; and switching means for switching the data voltage stored in the storage means in response to the sampling control signal.

3. The driving apparatus according to claim 2, wherein the storage means includes a first switch, a sampling switch, and a capacitor which stores the data voltage, wherein the first switch is connected between an output line of the current generating circuit and a control terminal of the sampling switch, wherein the capacitor is connected between the control terminal of the sampling switch and the supply voltage line, and the control terminal is connected to a node positioned between the first switch and the capacitor, and wherein the sampling switch connected between the first switch and the supply voltage line.

4. The driving apparatus according to claim 3, wherein the storage means further includes a second switch connected between the first switch and the sampling switch.

5. The driving apparatus according to claim 4, wherein the first and second switches are simultaneously turned on in the horizontal period in response to the sampling control signal and then sequentially turned off.

6. The driving apparatus according to claim 5, wherein the second switch is turned off prior to the first switch.

7. The driving apparatus according to claim 5, wherein the third switches of the first and second sampling circuits are driven alternately for each horizontal period in response to the sampling control signal.

8. The driving apparatus according to claim 4, wherein the switching means includes a third switch connected between the node and the analog buffer, the third switch switching a voltage stored in the capacitor into the analog buffer.

9. The driving apparatus according to claim 4, wherein a voltage from the supply voltage line flows into the current generating circuit through the sampling switch, the second switch, the first switch and the output line of the current converting circuit, and the capacitor stores the voltage between the control terminal and the input terminal of the sampling switch.

10. The driving apparatus according to claim 3, wherein the switching means includes a third switch connected between the node and the analog buffer, the third switch switching a voltage stored in the capacitor into the analog buffer.

11. The driving apparatus according to claim 10, wherein the first sampling circuit stores the data voltage into the capacitor during an horizontal period N, wherein N is an integer, while applying the data voltage stored in the capacitor to the analog buffer during an horizontal period (N+1), and the second sampling circuit stores the data voltage into the capacitor during the horizontal period (N+1) while applying the data voltage stored in the capacitor to the analog buffer during the horizontal period N.

12. The driving apparatus according to claim 10, wherein the first sampling circuit and the second sampling circuit store the data voltage into their respective capacitors during alternate horizontal periods.

13. A method of driving an electro-luminescence display panel comprising the steps of:

preparing an electro-luminescent display panel having electro-luminescent light-emitting cells provided at crossings of gate lines and data lines;

generating a current corresponding to an externally provided digital data;

sampling the current during each horizontal period to generate and store the data voltage corresponding to the current, wherein the step of generating and storing the data voltage includes:

generating the data voltage corresponding to the current using a voltage from a supply voltage line in response to a sampling control signal using first and second sampling circuits alternately for each horizontal period; and storing the data voltage using first and second capacitors;

applying the stored data voltage to the data lines; and driving the light-emitting cells using the data voltage.

14. The method according to claim 13, wherein the step of applying the stored data voltage to the data lines includes:

alternately switching the data voltage stored in the first and second capacitors of the first and second sampling circuits into a buffer at each horizontal period; and buffering the data voltage.

15. The method according to claim 14, further including a step of applying the buffered voltage to the data lines.

16. A method of fabricating an electro-luminescent display panel comprising the steps of:

providing an electro-luminescence display panel having electro-luminescent light-emitting cells arranged at crossings of gate lines and data lines;

providing a current generating circuit for generating a current corresponding to a digital data from the exterior; and providing a data driver for sampling the current from the current generating circuit for each horizontal period, for generating the data voltage corresponding to the current, and for applying the data voltage to the data lines at one side of a substrate, wherein the step of providing the data driver includes:

providing first and second sampling circuits for generating the data voltage; and providing an analog buffer for alternately buffering the data voltage supplied from the first and second sampling circuits at each horizontal period to apply the buffered data voltage to the data lines.

17. The method according to claim 16, wherein the step of providing the first and second sampling circuits includes:

providing a supply voltage line;

providing storage means driven with a sampling control signal for storing the data voltage corresponding to the current using a voltage from the supply voltage line; and providing switching means for switching the data voltage stored in the storage means into the analog buffer in response to the sampling control signal.

18. The method according to claim 17, wherein the step of providing the storage means includes:

providing a first switch connected between an output line of the current generating circuit and the supply voltage line;

providing a second switch connected between the first switch and the supply voltage line;

providing a sampling switch connected between the second switch and the supply voltage line; and providing a capacitor connected between a control terminal of the sampling switch connected to a node positioned between the first and second switches and the supply voltage line for storing the data voltage.

19. The method according to claim 17, wherein the step of providing the switching means includes providing a third switch connected between the node and the analog buffer for switching a voltage stored in the capacitor into the analog buffer.

* * * * *